US008056717B2

(12) United States Patent
Weissbrod

(10) Patent No.: US 8,056,717 B2
(45) Date of Patent: Nov. 15, 2011

(54) OVERWRAP FOR PACKAGED ARTICLES

(75) Inventor: Paul A. Weissbrod, South Euclid, OH (US)

(73) Assignee: Lincoln Global, Inc., City of Industries, CA (US)

( * ) Notice: Subject to any disclaimer, the term of this patent is extended or adjusted under 35 U.S.C. 154(b) by 9 days.

(21) Appl. No.: 12/482,055

(22) Filed: Jun. 10, 2009

(65) Prior Publication Data

US 2010/0000895 A1 Jan. 7, 2010

Related U.S. Application Data

(60) Provisional application No. 61/078,626, filed on Jul. 7, 2008.

(51) Int. Cl.
*B65D 85/672* (2006.01)

(52) U.S. Cl. ..... 206/410; 206/400; 206/414

(58) Field of Classification Search ..... 206/410, 206/298, 400, 401, 303, 414, 415, 416; 53/409, 53/204; 229/5.5, 5.6, 5.8; 493/157, 308
See application file for complete search history.

(56) References Cited

U.S. PATENT DOCUMENTS 1,772,850 A * 8/1930 Wheldon ..... 206/414
2,883,045 A * 4/1959 Abramson ..... 206/396
3,006,522 A * 10/1961 Arneson ..... 229/5.5
3,120,337 A * 2/1964 Thomsen ..... 229/87.01
3,451,610 A * 6/1969 Beichler et al. ..... 229/109
3,850,294 A * 11/1974 Philipps et al. ..... 206/205
4,524,562 A 6/1985 Yagi et al.
4,621,763 A * 11/1986 Brauner ..... 229/5.5
4,667,824 A 5/1987 Ditchfield
4,872,301 A 10/1989 Langen et al.
4,924,654 A 5/1990 Langen et al.
5,105,943 A 4/1992 Lesko et al.
5,907,941 A * 6/1999 Fukuzumi et al. ..... 53/136.2
6,155,421 A * 12/2000 Cooper ..... 206/400
6,221,297 B1 4/2001 Lanoue et al.
6,637,593 B2 10/2003 Weissbrod
6,715,608 B1 4/2004 Moore
6,779,662 B2 8/2004 Dorsey
7,080,734 B1 * 7/2006 Morris et al. ..... 206/400
7,107,737 B2 9/2006 Spatafora
7,222,734 B2 5/2007 Barton
2003/0019776 A1 * 1/2003 Matsuguchi et al. ..... 206/443
2008/0236102 A1 * 10/2008 Murakami et al. ..... 53/405

* cited by examiner

*Primary Examiner* — David Fidei
(74) *Attorney, Agent, or Firm* — Hahn Loeser & Parks LLP

(57) ABSTRACT

An overwrap provides cushioning and protection for an object, stored in a bag or other container, during transport and/or storage. The overwrap has a generally smooth exterior surface and textured interior surface that is pliable for conforming to bumps or other raised portions of the object thereby providing a generally smooth exterior covering that minimizes frictional forces with the bag. The overwrap may include one or more folding scores that allow the body of the overwrap to bend into a channel. A plurality of material discontinuities may also be included that allow the overwrap of conform to the object without bunching.

18 Claims, 12 Drawing Sheets

OVERWRAP FOR PACKAGED ARTICLES

The U.S. utility patent application claims priority to U.S. provisional patent application, Ser. No. 61/078,626, filed on Jul. 7, 2008, which is incorporated herein by reference in its entirety.

FIELD OF THE DISCLOSURE

The present disclosure relates generally to the field of packaging articles, and more particularly to an over-wrap that provides cushioning and absorbs friction at pressure points on a cylindrical object, such as a coil of wire.

BACKGROUND

Wire used in certain processes may be wound and stored on cores as coils. The wire is frequently wound around a central core and secured by metal tie wires that extend through the coil, and across the outer turns of the coiled wire. The tie wires are typically spaced circumferentially around the diameter of the coil and secured by twisting and cutting off the ends of the metal wire forming bumps or protrusions on the surface of the coil.

In packaging the wire, the coil may be placed in a bag constructed from generally pliable material like plastic, paper, or vapor corrosion inhibiting (VCI) paper. The bag may also be constructed from foil laminate structures to preserve conditions inside bag. In certain welding processes, the coil of wire, or electrode, is hermetically sealed to prevent ambient conditions from affecting the wire. To ensure freshness, the air in the bag may be evacuated to preserve the atmospheric conditions inside the package. This ensures that the electrode meets performance specifications when the coil arrives at the desired location. However, during transportation and/or handling, protrusions on the surface of the enclosed article, e.g. wire, form pressure points that act abrasively to damage the bag, rupturing or breaking the vacuum seal. The abrasion increases friction that may lead to eventual tearing of the bag or breaching of the bag seal.

BRIEF SUMMARY

Embodiments of the invention disclose a single-face kraft corrugate overwrap that provides cushioning and absorbs friction at pressure points on an associated object. The object may be a generally cylindrical coil of wire and may have protrusions on its outer surface. Frictional forces between the object and related packaging are reduced or eliminated as the overwrap deforms around the circumferential edge of the object and further extends over its top and bottom faces to prevent contact, and more specifically abrasion, between the protrusions and the related packaging. The overwrap inhibits tears or holes and thus moisture from entering the bag. As a result, the object preserves its manufactured factory properties and arrives at the destination with the same atmospheric conditions as at the time of packaging.

DETAILED DESCRIPTION OF THE DRAWINGS

Figure 1:
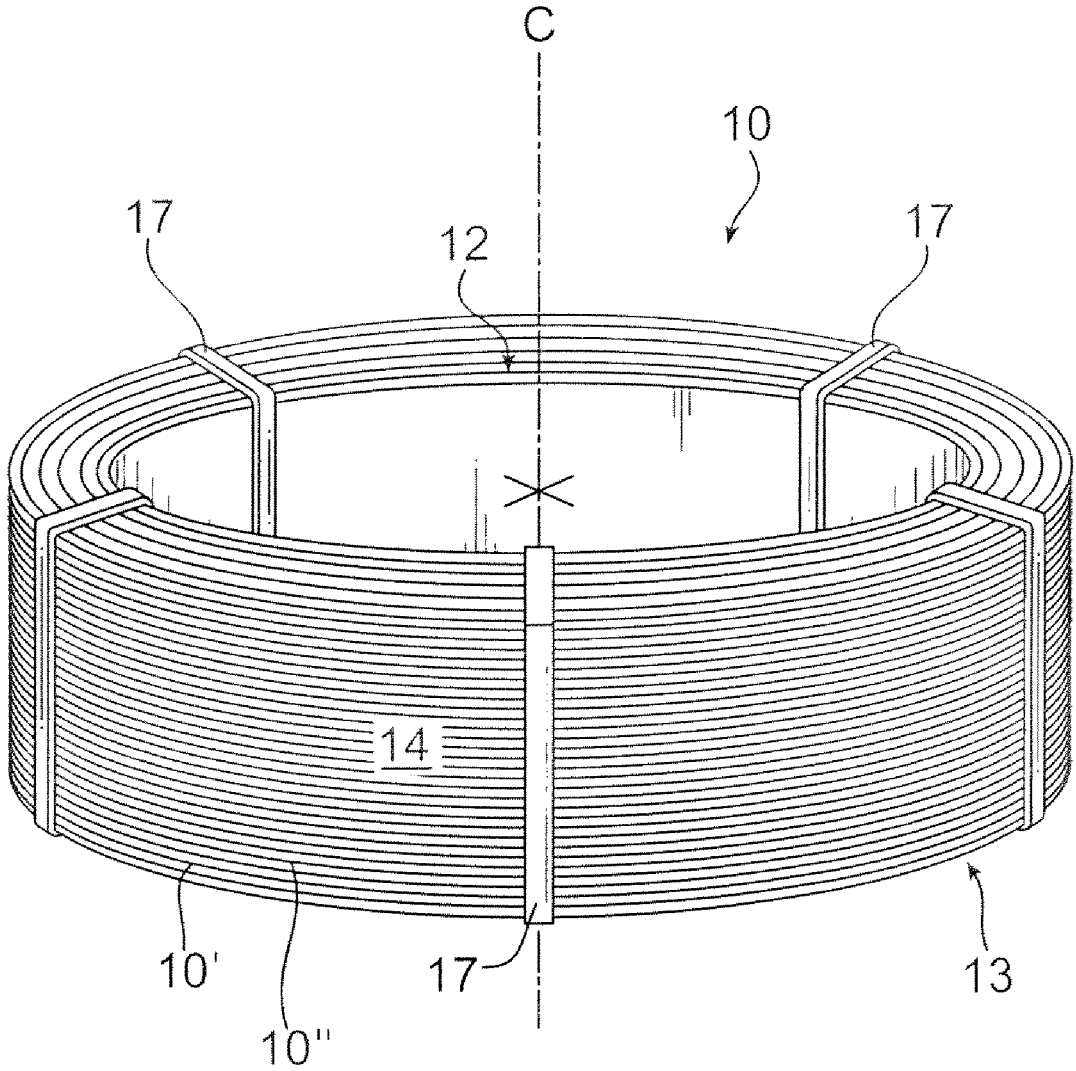
FIG. 1 is a perspective view of an object having faces and an intermediate circumferential surface.
Figure 2:
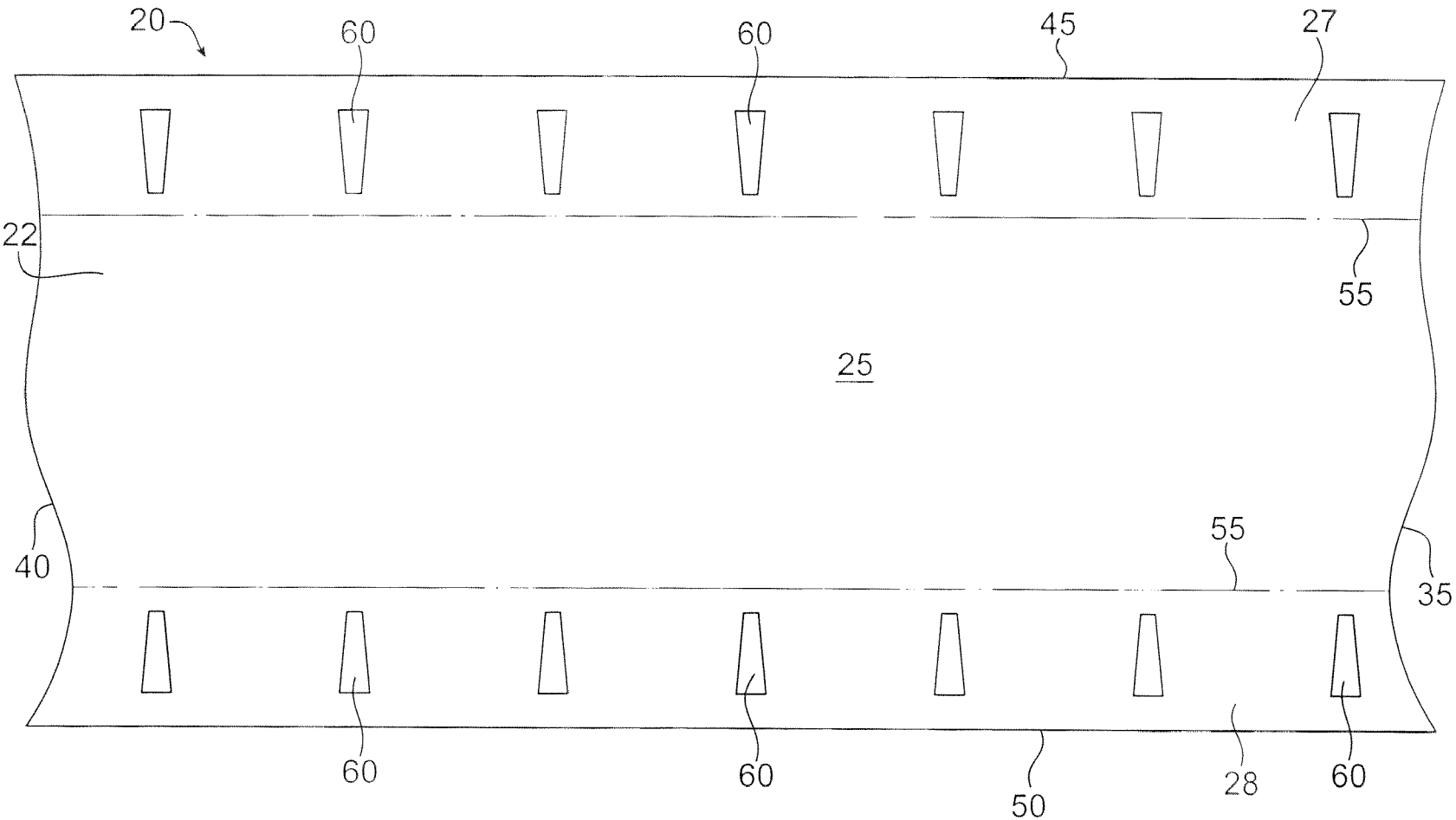
FIG. 2 is a top view of the exterior surface of an overwrap, according to the embodiments of the subject invention.
Figure 3:
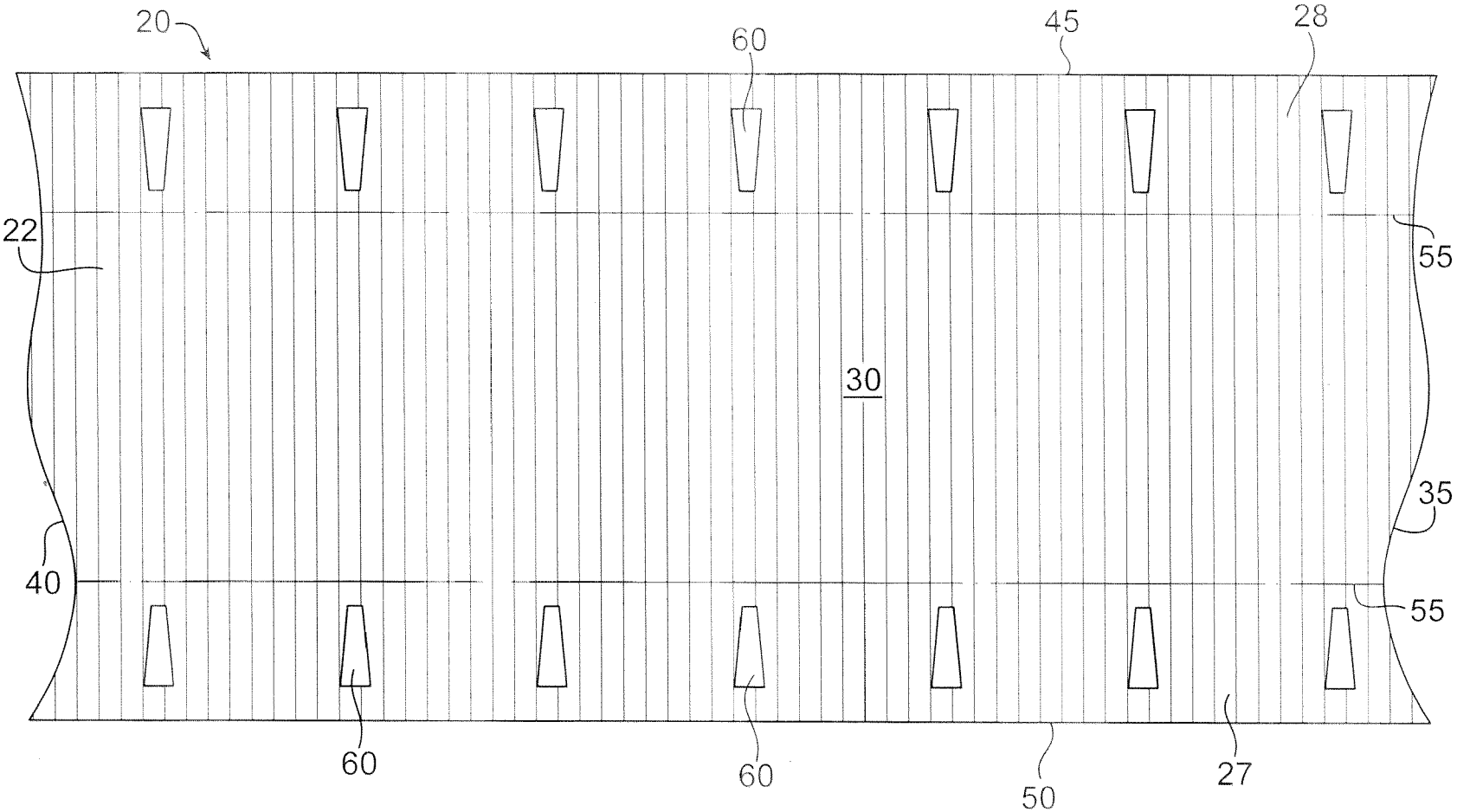
FIG. 3 is a top view of the interior surface of the overwrap of FIG. 2, according to the embodiments of the subject invention.

The embodiments of the present disclosure relate to an overwrap 20 for an object 10 having a rounded or otherwise polygonally circumscribed faces 12, 13 and a method of preserving the object 10 stored within enclosed and/or sealed packaging 15. The object 10 may be generally cylindrical in shape having faces 12, 13 spaced apart by an intermediate circumferential surface 14, wherein a center axis C is defined, which may be substantially perpendicular with each of the faces 12, 13. One example of such an object 10 is a coil of wire 10', which may comprise welding wire 10", shown in FIG. 1. The wire 10' may be wound into a coil for packaging purposes (see FIGS. 1*a* and 1*b*). Accordingly, wire ties 17 or other fasteners may be used to hold the coiled wire 10' together for packaging into a bag 15 until opened for use by an end user. In many instances, wire 10' requires isolation from exposure to the atmosphere or ambient conditions. The coil of wire 10' may therefore be placed into a hermetically sealed bag 15 or other container where the air can be subsequently evacuated. However, it will be appreciated that handling and stacking of the coils 10' causes friction and wear that may breach the bag seal, especially at raised portions or protrusions extending from the surface of the coil of wire 10'. FIGS. 2 and 3 show an exemplary overwrap 20 in an extended position before it has been applied to the object 10. Application of the overwrap 20 around the coil of wire 10' provides an intermediate layer of protection, the novel aspects of which will be described in the following paragraphs, that functions to absorb or eliminate pressure from protrusions or unevenness in the surface of the object 10, or coil 10' caused by fasteners, wire ties, the coil configuration, or other means.

Referencing FIGS. 2 and 3, the overwrap 20 may be comprised of a planar and generally pliable piece of material having an exterior surface 25, an interior surface 30, first 35 and second 40 ends, and first 45 and second 50 sides. The overwrap 20 may be segmented into a main body portion 22, also termed overwrap body 22, and legs or side panels 27, 28 extending from overwrap body 22. The legs or side panels 27, 28 may be delineated by one or more folding scores 55 that allow the material comprising the overwrap 20 to bend or fold as will be discussed further below. In one embodiment, the side panels 27, 28 include a plurality of material discontinuities 60 or breaks 60 fashioned therein. Illustratively, the material discontinuities 60 may comprise slots 60', which may be gaps or through-holes, fashioned in the side panels 27, 28. In another embodiment, the material discontinuities 60 may comprise slits 60" (see FIG. 9), or just variances in material thickness, the relevance of which will be discussed below.

Figure 1A:
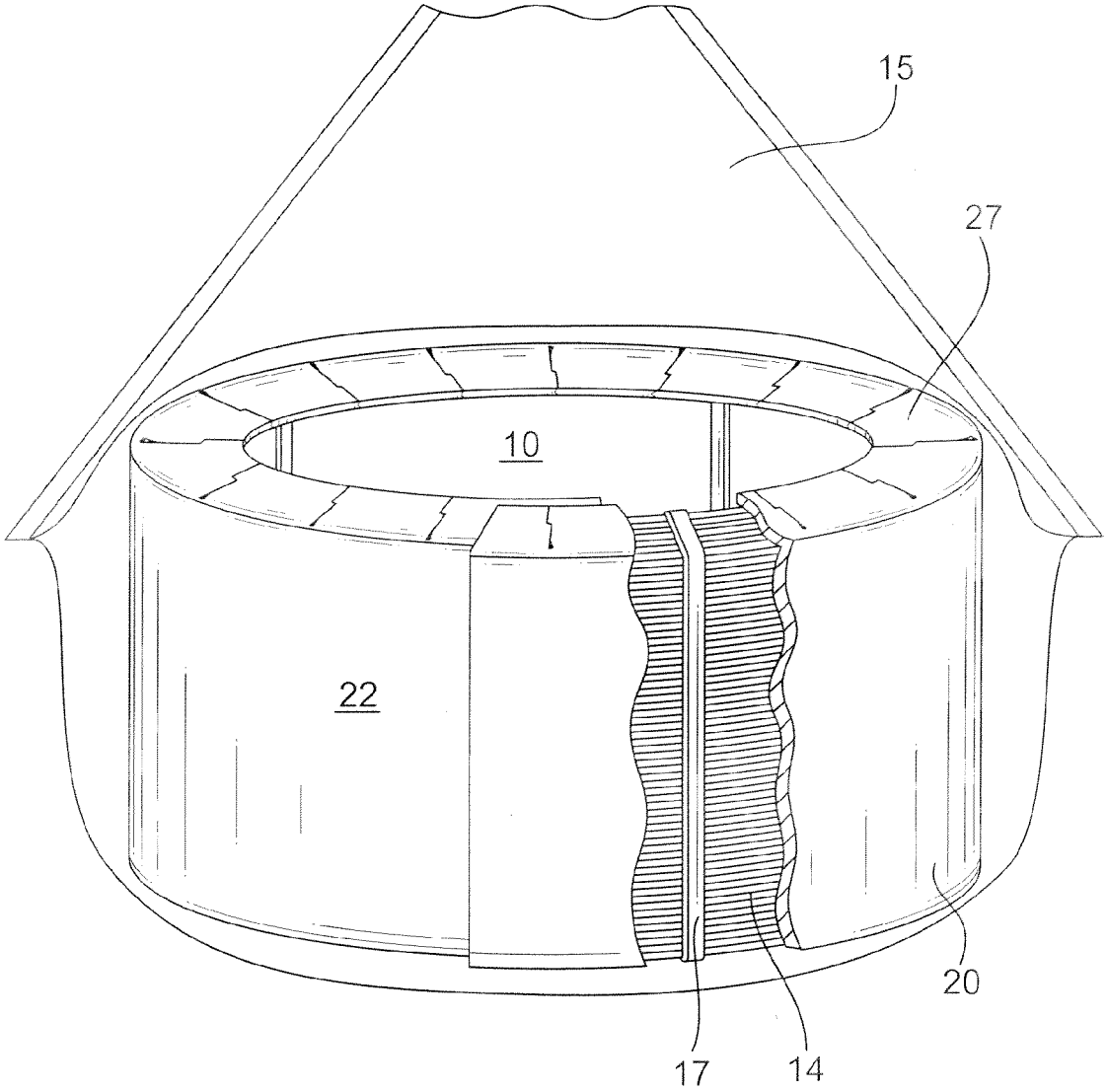
FIG. 1*a* is a partial cutaway perspective view of the object, of FIG. 1, including an overwrap being placed into a bag or container, according to the embodiments of the subject invention.

With reference to FIG. 1*a*, the overwrap 20 is constructed to conform to the surfaces of the cylindrical object 10, or coil of wire 10'. In particular, the overwrap covers the circumferential surface 14 and faces 12, 13 from contact with the sealed bag 15 or container. It will be observed from review of the figures and description contained herein that the overwrap 20 folds upon itself in a uniform manner to form a smooth exterior surface substantially free from protrusions or raised portions that would otherwise create pressure points against the sealed bag 15 or container during shipping and handling.

The overwrap 20 may be constructed from a single-faced corrugate kraft or other monolithic piece of material having a smooth exterior surface 25 and a generally compressible body. The smooth exterior surface 25 minimizes frictional forces between the bag 15 and object 10, or coil of wire 10', that may cause the bag 15 to rupture during handling. It should be noted that the present embodiment is not limited to specific dimensions as the overwrap 20 can be constructed to fit object 10 or coils of wire 10' of various dimensions.

FIG. 3 shows the interior surface 30 of the overwrap 20 in the extended position, again before application to the object 10 or coil of wire 10'. The interior surface 30 may be textured, and more specifically may include a series of undulations, such as may be found in materials like cardboard, undulated polymeric material or other similarly configured materials. It will be appreciated that the undulations may be compressible and therefore provide a layer of cushioning useful in preserving the outer packaging, i.e. bag 15, by conforming to the protrusions on the surface of the object 10. Stated another way, the overwrap 20 accounts for protrusions by deforming at the region of the raised protrusions leaving a level surface on the surrounding sides of the overwrap 20. Accordingly, the overwrap 20 may be constructed from these types of materials and/or combinations of these materials. In one particular embodiment, the overwrap 20 is constructed from single-face kraft corrugate cardboard. However, any generally pliable and/or corrugated material is to be construed as falling within the scope of coverage of the appended claims. Once conformed to the object 10, the overwrap 20 may subsequently be placed into a bag or container 15 and hermetically or vacuum sealed.

Figure 4:
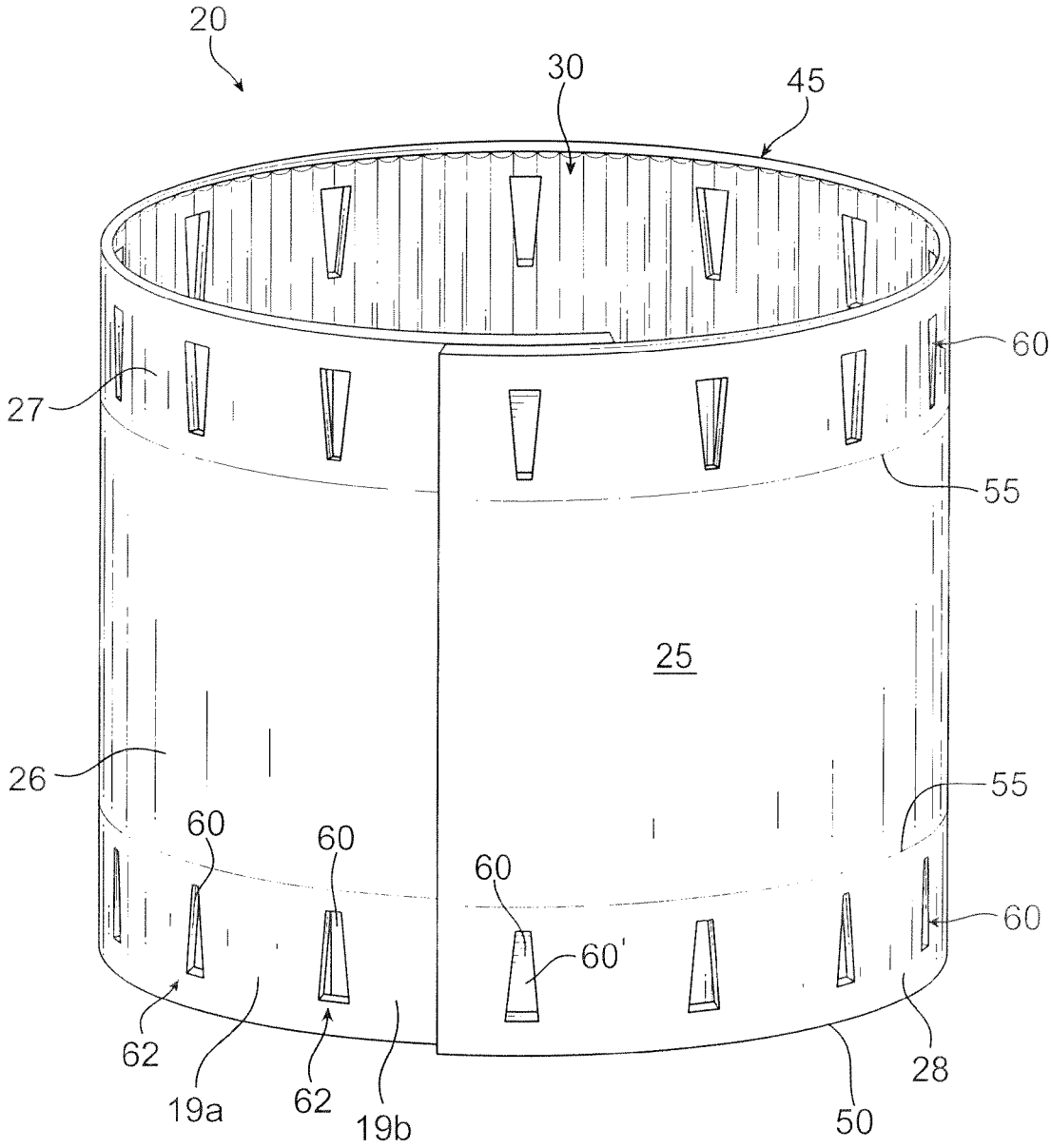
FIG. 4 is a perspective view of the overwrap of FIG. 2, partially formed, according to the embodiments of the subject invention.
Figure 5:
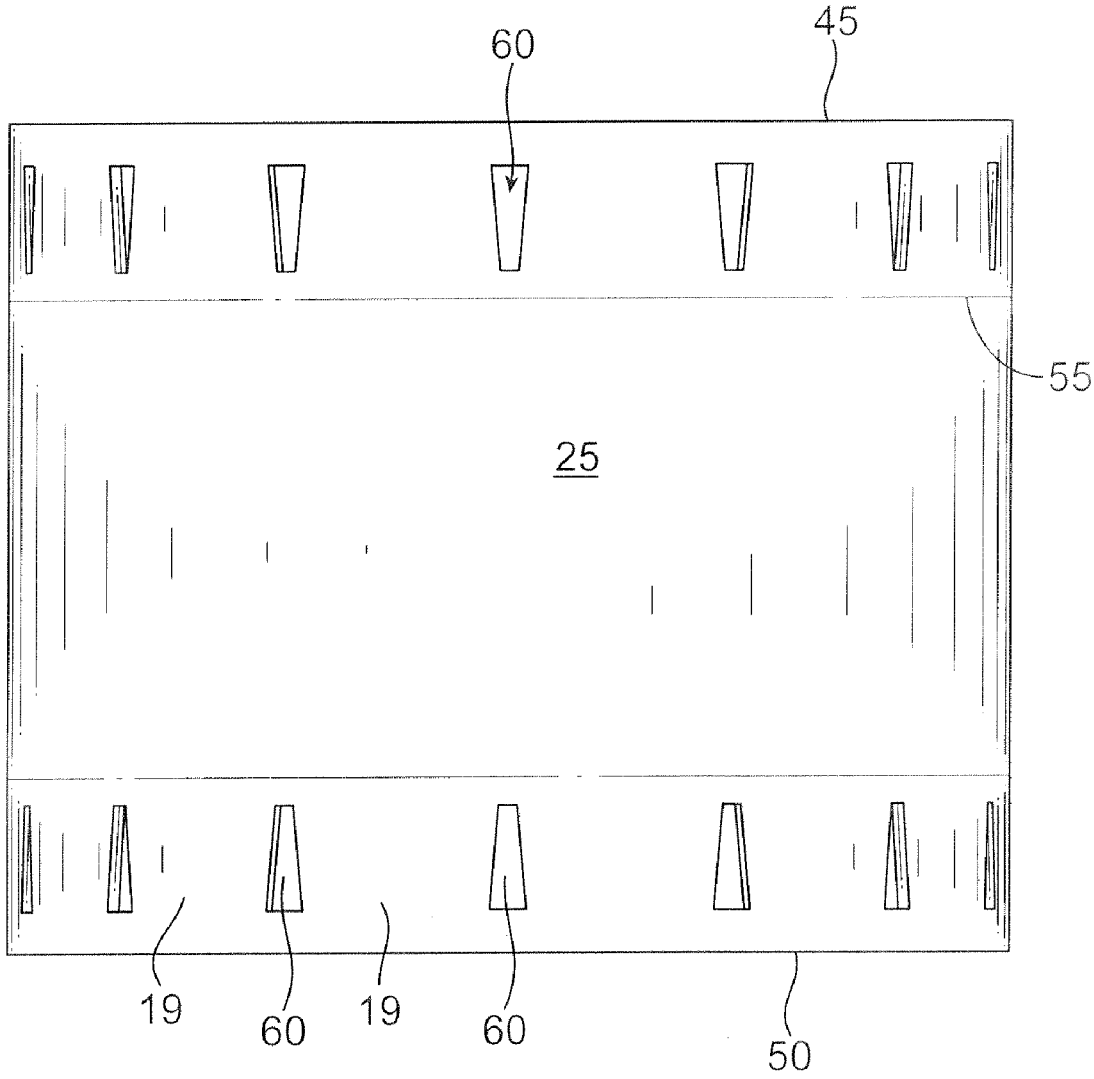
FIG. 5 is a side view of the overwrap of FIG. 2, partially formed, according to the embodiments of the subject invention.
Figure 6:
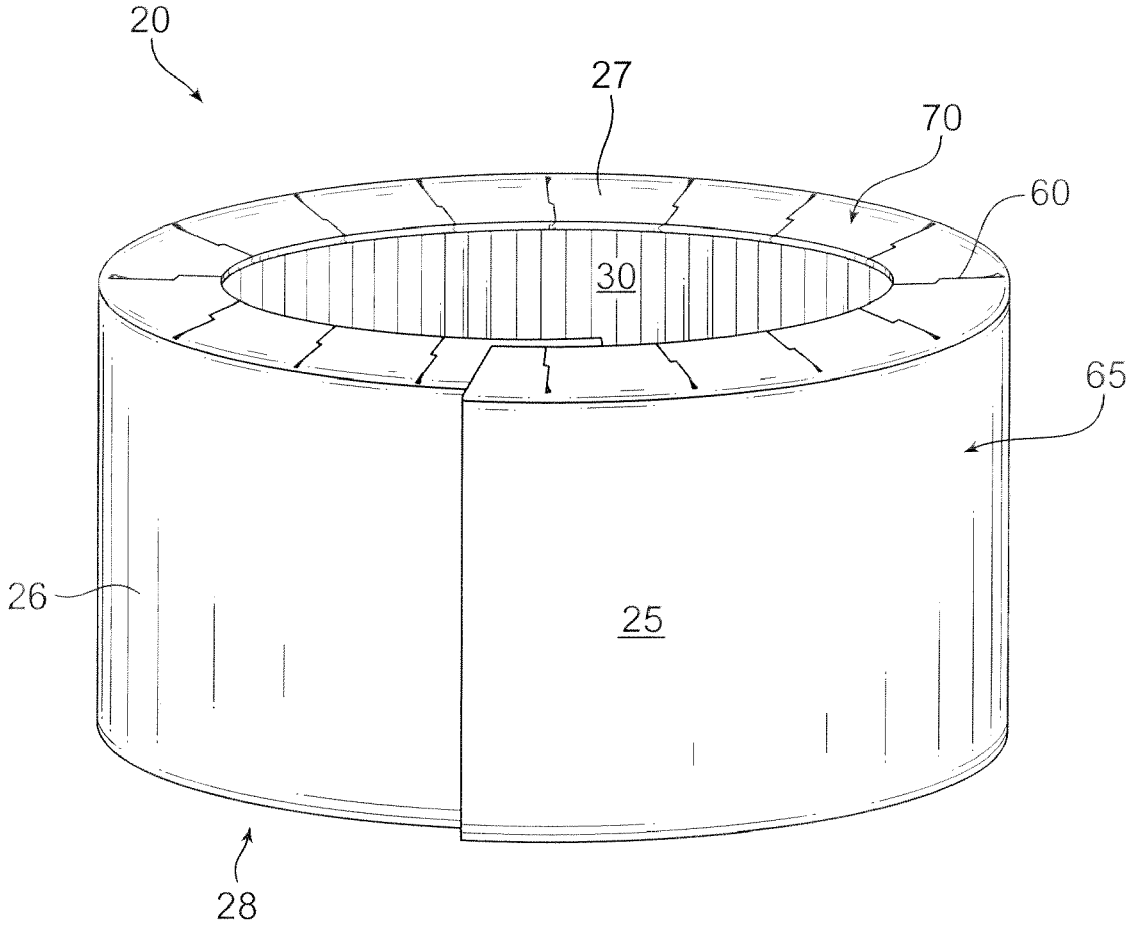
FIG. 6 is a perspective view of the overwrap of FIG. 2, forming a channel, according to the embodiments of the subject invention.

With reference now to FIGS. 1*a*, 4, and 6, when conforming the overwrap 20 to the object 10 or coil of wire 10', the overwrap 20 may be placed adjacent to the coil of wire 10' so that either the interior 30 or exterior 25 surface contact the surface thereof. In one embodiment, the interior surface 30 is positioned adjacent to the coil of wire 10'. However, the surfaces operate in a reversible manner to absorb frictional forces and provide cushioning to the coil of wire 10' during transport or handling. In order to conform around the coil of wire 10', the overwrap 20 may include one or more folding scores 55 located on the interior surface 30 and/or exterior surface 25. The scores 55 facilitate shaping the overwrap into a channel having a central region 26, a top or first side panel 27, and a bottom or second side panel 28 that receives the wire 10' as the channel is folded or rolled around the coil. By channel it is meant that the central region 26 forms an angle with each of the top and bottom legs or side panels 27, 28 thereby creating a generally concave interior region and external surface. The angle(s) may be substantially 90° resulting in a U-shaped cross-section, although any angle may be chosen with sound judgment. It is be noted that the boundary of the side panels 27, 28 may be defined by the folding scores 55. Still, alternate embodiments are contemplated wherein side panels 27, 28 are formed without scoring the material comprising the overwrap 20.

It will be observed that covering the faces 12, 13 of object 10 with a contiguously formed or monolithic piece of material not having material discontinuities results in bunching of the overwrap material at various places on the object surface. To level out or eliminate bunched or protruding material during the conformal overwrap process, the overwrap 20 includes a series of material discontinuities 60 that allow the overwrap 20 to fold uniformly over the object faces 12, 13. More specifically, the material discontinuities 60 may be fashioned in the side panels 27, 28, which as described above extend to cover the rounded or otherwise circumscribed faces 12, 13. Material discontinuities 60, as mentioned above, may refer to breaks or disruptions in the continuity of the material comprising the side panels 27, 28. In one embodiment, the material discontinuities 60 may comprise a slot 60' characterized by a void or removal of material that leaves an opening or gap in the overwrap 20. In another embodiment, the material discontinuities 60 may be comprised of slits 60", described below. In yet another embodiment, material discontinuities may comprise differences in thickness or makeup of one section of material with respect to an adjacent section of material. Still, any manner of forming material discontinuities 60 may be chosen without departing from the intended scope of coverage of the embodiment of the subject invention.

With reference to FIGS. 4 through 9, one of skill in the art will readily see that the material discontinuities 60 segment the side panel 27, 28 into adjacent side panel sections 19, which fold upon itself, i.e. overlap, to conform to the face 12, 13 of the object 10 without bunching together thereby resulting in a substantially level surface. It is noted that a plurality of spaced apart material discontinuities 60 may be incorporated into the overwrap 20 so as to define a plurality adjacent side panel sections 19. In one particular embodiment, the material discontinuities 60 are formed longitudinally across the lateral face of the side panels 27, 28 and may have a longitudinal dimension that is shorter than the width of the side panels 27, 28. More specifically, the material discontinuities 60 may be centered about the width of the side panels 27, 28, although any length and/or position may be chosen with sound engineering judgment. Additionally, any spacing and/or angle of orientation of the plurality of material discontinuities may be chosen as is appropriate for conforming the overwrap 20 to the object faces 12, 13 without bunching.

Figure 7:
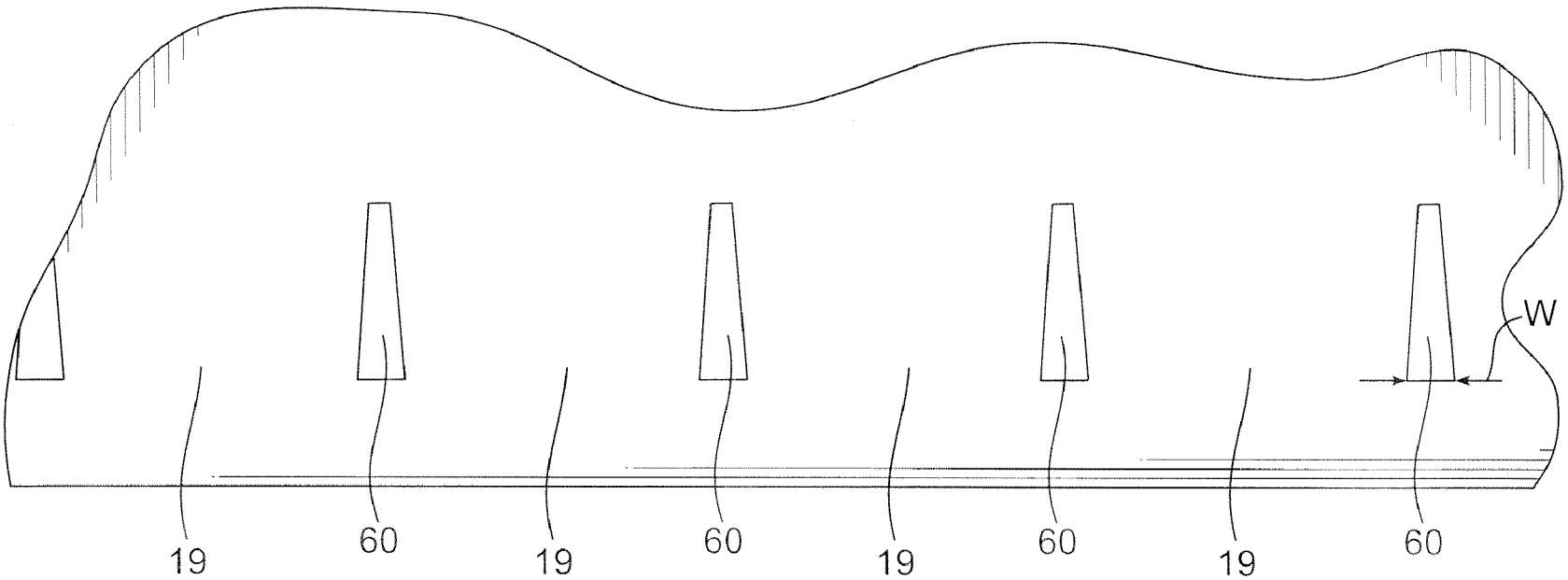
FIG. 7 is an exploded view of the plurality of material discontinuities fashioned in the overwrap, shown in FIGS. 2 and 3, according to the embodiments of the subject invention.
Figure 9:
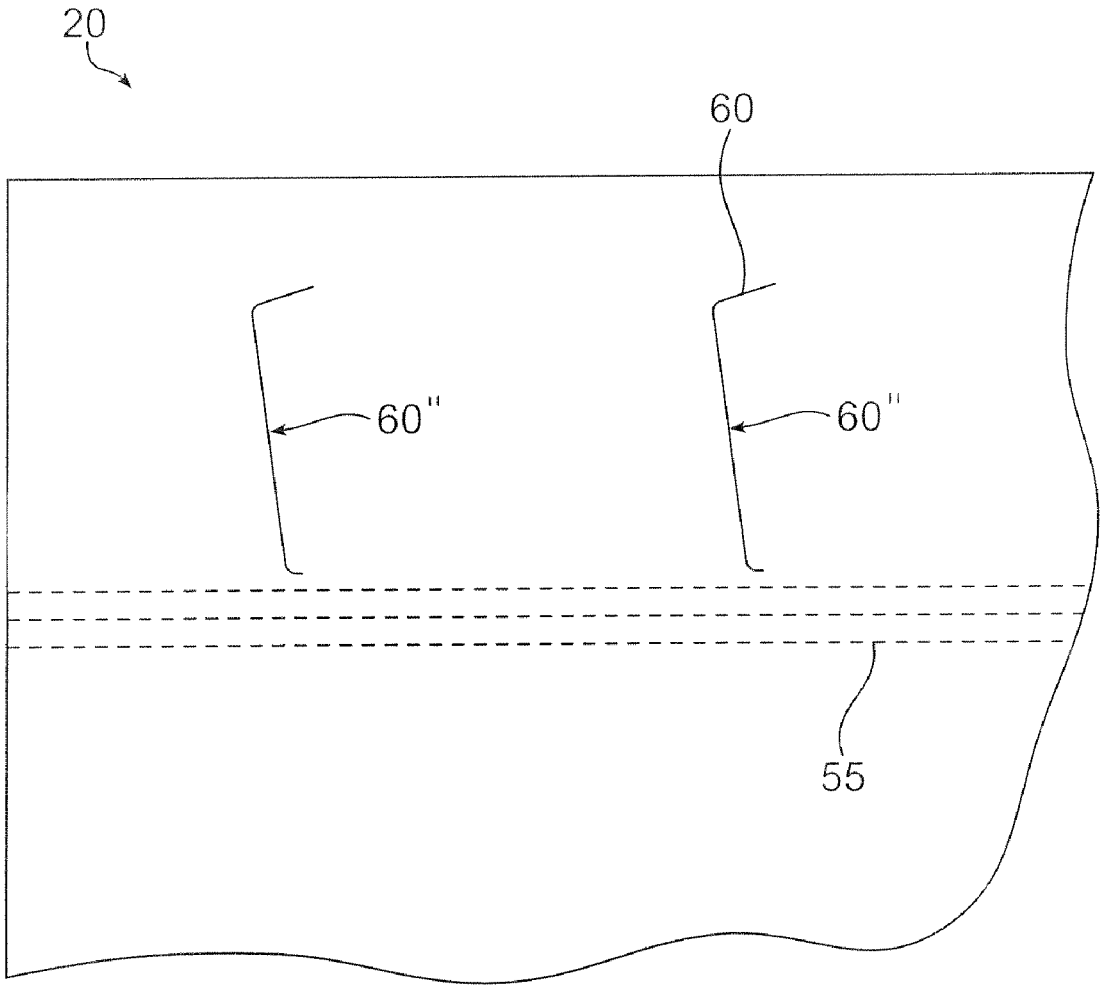
FIG. 9 is an exploded view of a plurality of material discontinuities, according to the embodiments of the subject invention.
Figure 10:
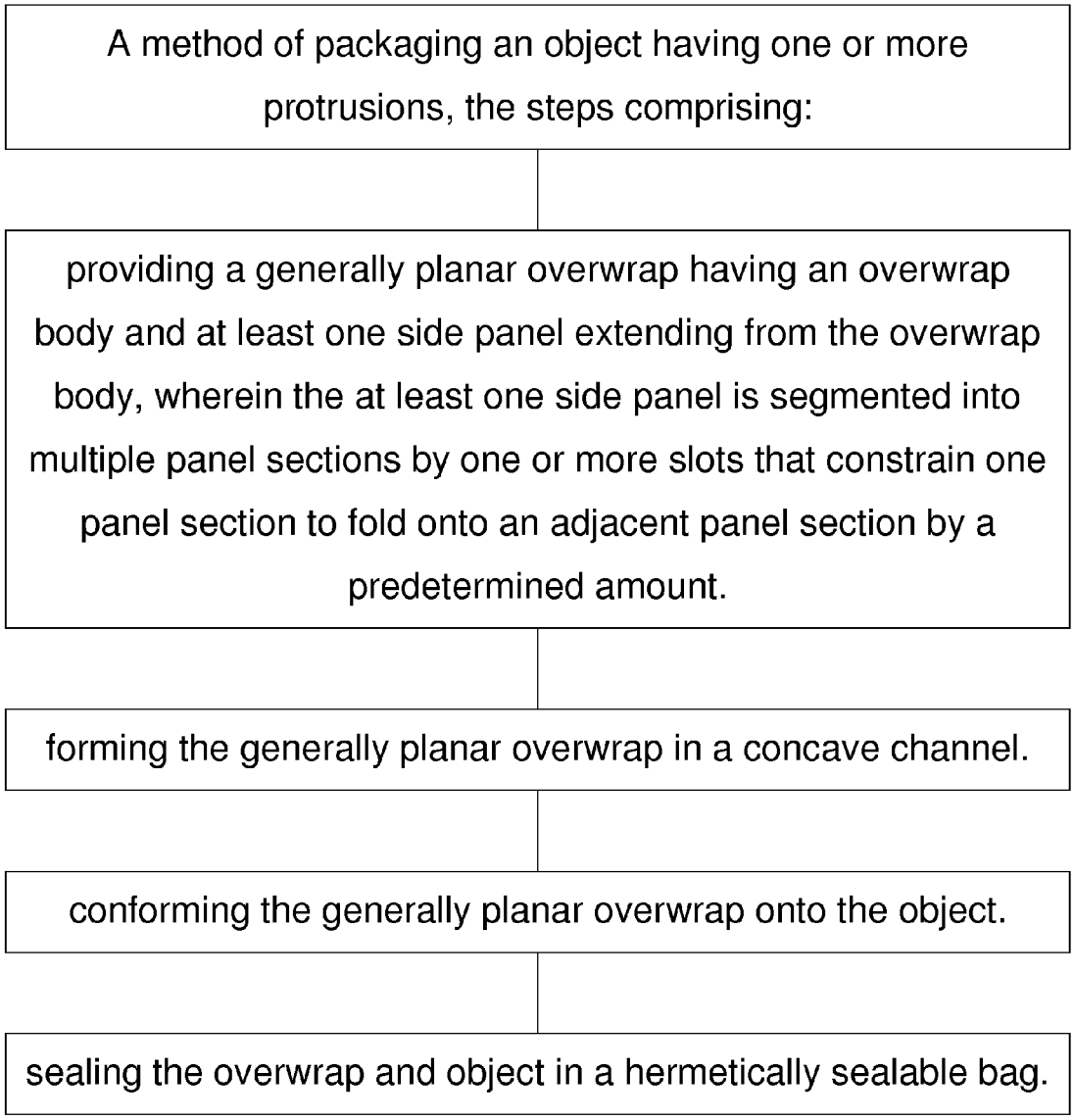
FIG. 10 is a block diagram of a method of packaging an object, according to the embodiments of the subject invention

With reference now to FIGS. 7 and 9, the material discontinuities may comprise slots 60' shown having a "V"-shaped or generally tapered configuration, with the wider end of the end slot 60' adjacent the edges 45, 50 of the overwrap 20. Slot 60' may have a characteristic width W defined by the broad end of the tapered gap. It follows that the edges of the slot 60' may be angled, with any angle chosen that is suitable for covering the surface of object 10. However, the configuration of slot 60' is not limited to the present embodiment. Alternately, the material discontinuities 60 may comprise one or more slits 60", as shown in FIG. 9, characterized by a cut or cuts in the material. The cut(s) comprising the slit 60" may include multiple straight cut edges fashioned at acute angles, or may include curved cuts. The cuts function to allow uniform overlap during the conformal overwrap process, as will be readily seen. In any configuration, both the slots 60' and slits 60" allow the overwrap 20 to fold uniformly and deform around the object 10 or coil of wire 10' so as to substantially not leave any raised portions over the surface of the covered object 10. It is also to be construed that combinations of slots 60' and slits 60" together may be incorporated into the overwrap 20. In these ways, the material of the overwrap 20 between the material discontinuities 60, i.e. adjacent side panel sections 19, will conform or fold upon itself to substantially or completely cover any open region of the material discontinuities 60.

Accordingly, during installation, the plurality of material discontinuities 60 allow the overwrap 20 to conform to the object 10 or coil 10' faces 12, 13 by allowing the edges of the side panel sections 19 to flow evenly together or pass each other, which is to say overlap. In this manner, the side panel sections 19 substantially close any open gaps in the material of the side panels 27, 28 while forming a generally smooth and level surface absent protrusions that might otherwise rub against the interior of the bag 15 (see FIG. 8).

With reference again to FIGS. 4 and 8, the overwrap 20 may include a web 62 or webbing 62 that limits the travel of the adjacent side panel sections 19. In particular, web 62 constrains the movement of one side panel section 19*a* with respect to an adjacent side panel section 19*b*. As stated above, the length of the material discontinuities 60 may fall short of the side panel's boundaries or edges. The web 62 may therefore be defined as that portion of material in between the end of the material discontinuities 60 and the side 45 or 50 of the overwrap 20 respectively. Stated differently, the web 62 or webbing 62 may be referred to as that material adjacent the discontinuity 60 ends. It follows that the width of web 62 is commensurate with the width W of the respective material discontinuity 60. In fact, it is the web width that constrains or limits how far one side panel section 19*a* moves with respect to an adjacent side panel section 19*b*.

Figure 8:
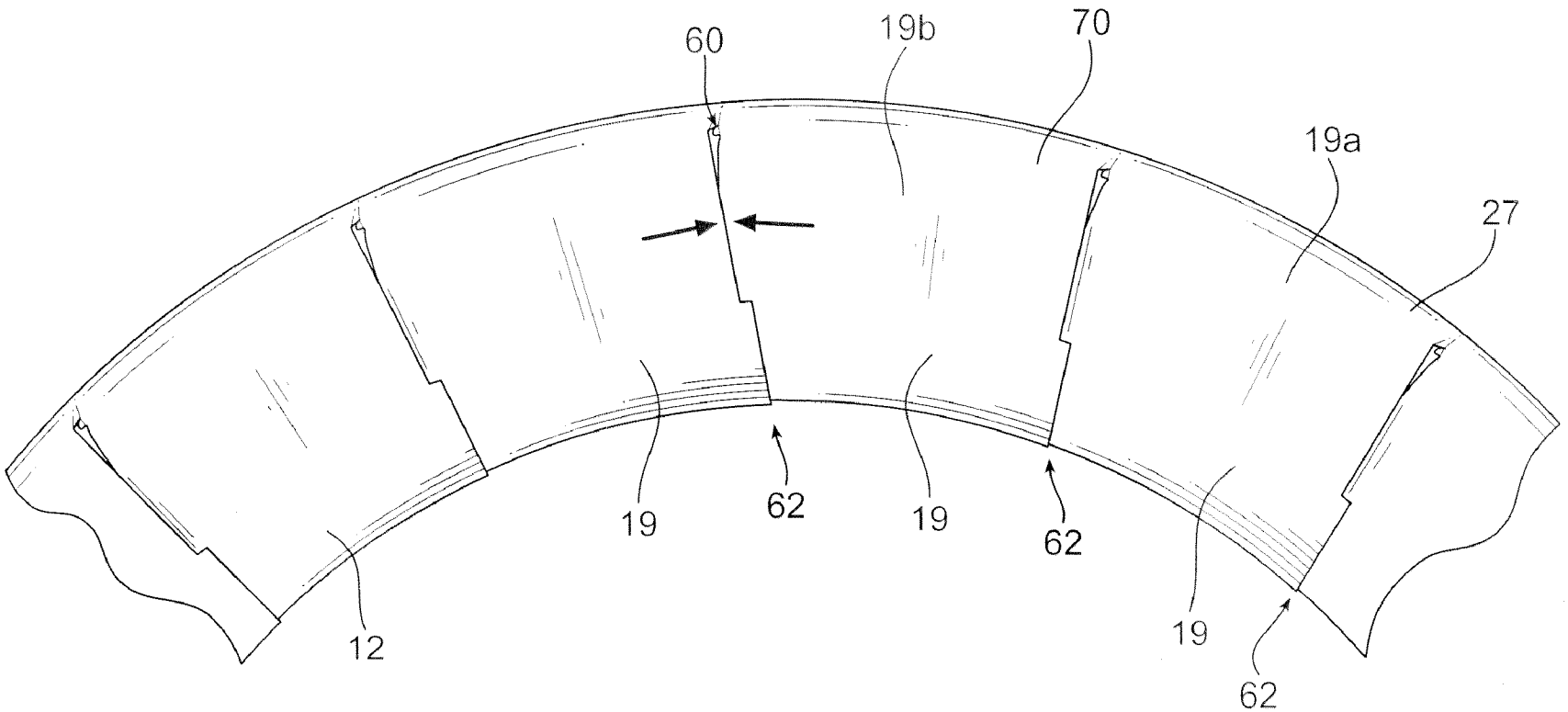
FIG. 8 is a partial top view of the plurality of material discontinuities in the overwrap folded together in the conformal position, according to the embodiments of the subject invention.

It will be readily seen that the webbing 62 is contiguously formed around an inner circumference of the side panels 27, 28. In this way, the webbing 62 circumscribes the edges or boundaries of the side panels 27, 28 and more particularly the plurality of spaced apart material discontinuities 60. Accordingly, the webbing 62 controls the positioning and/or overlap of each respective side panel section 19 and the openings therebetween. As a result, the side panel sections 19 can only move so far before web 62 limits the travel of that particular segment. The limiting action of the web 62 and the contraction of each opening, drives uniform bending and rolling of the side panels 27, 28 around the exterior of the object 10 or coil 10'. FIG. 8 provides an example of the folding action of the side panel sections 19. The side panel sections 19 in between each of the material discontinuities 60 come together and thereby form a cover for the gap when the overwrap 20 is rolled in a conformal manner around object 10. While it may be possible, given the type of corrugate, to physically force an overlap of the side panel sections 19 beyond the distance constrained by the webbing 62, it will be appreciated that the resulting overlap will not be uniform or level but will result in a bunching of material that forms new pressure points against which the bag 15 may rupture as a result of handling. Therefore, web 62 appropriately limits bypass of each adjacent side panel section 19 and allows the side panels to conform over the faces of the object creating a smooth and level surface to further protect the coil.

With reference again to FIGS. 5 and 6 but now especially to FIG. 8, as the side panels 27, 28 conform to the face 12, 13 of the object 10 or coil of wire 10', the amount of folding, or travel distance, at one end of the material discontinuity differs with respect to its distal end. In alternate embodiments where the width of the side panels 27, 28 increases, i.e. approaches the center axis C of the object 10, the length of the material discontinuity 60 may similarly increase. In this manner, the configuration of the material discontinuities 60 may be proportional to the width of the side panels 27, 28. It follows that the terminating width W of the material discontinuities 60 may also be proportioned to provide an amount of overlap suitable for covering openings in the side panels 27, 28 and for causing uniform folding and/or overlap of the side panel sections 19.

Figure 1B:
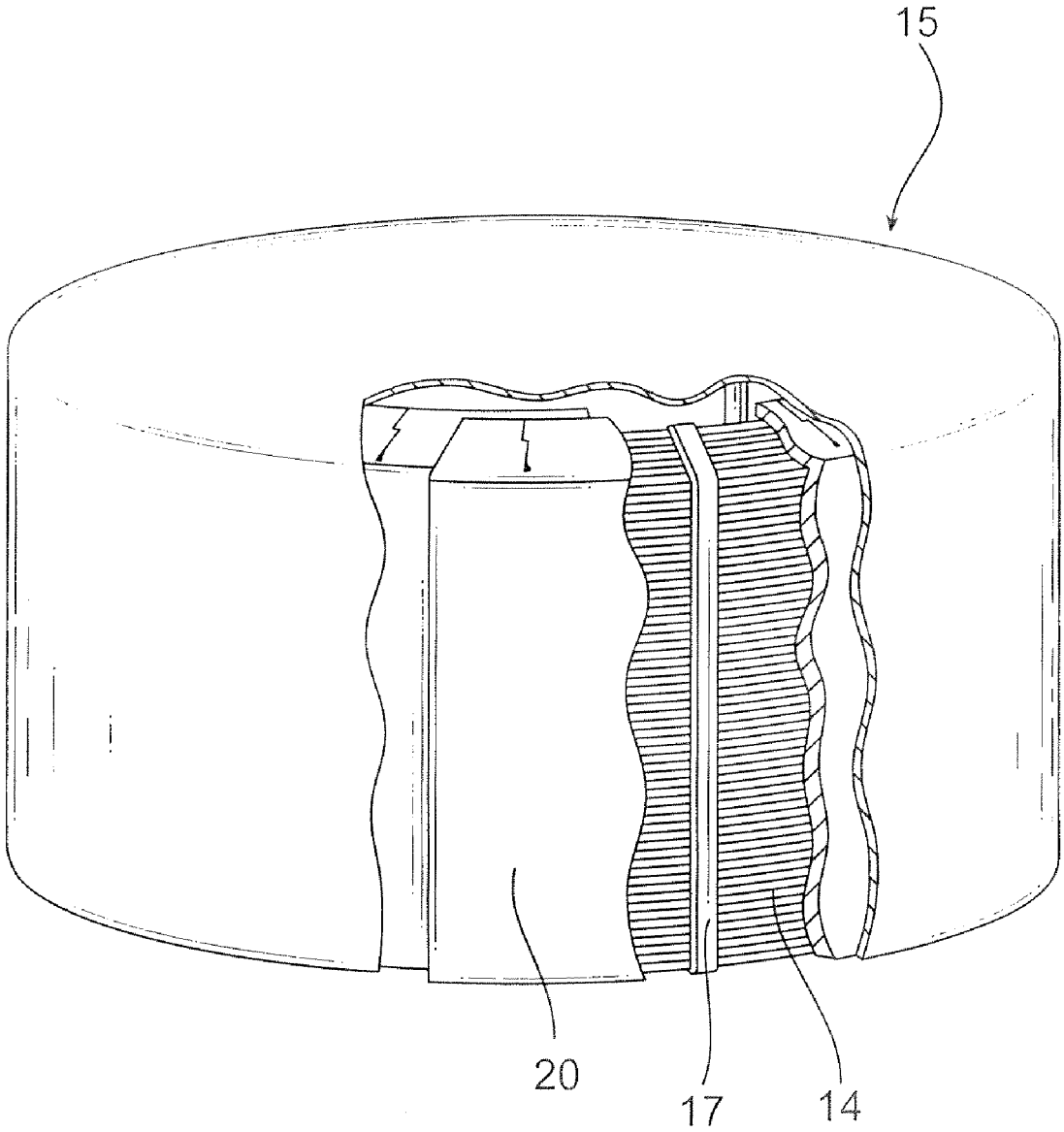
FIG. 1*b* is a partial cutaway perspective view of the object of FIG. 1 covered with an overwrap and sealed within a bag or container, according to the embodiments of the subject invention.

In operation, the overwrap 20 may be formed from a contiguous and generally planar piece of material or sheet. The material may have a length, or be fashioned to a length, that corresponds to the circumferential surfaces of the object 10 to be covered by the overwrap 20. It is noted that the length may be greater than the circumference of the object 10 to accommodate one or more fasteners for securing the ends of the overwrap 20 together. A width may be selected that allows the overwrap 20 to conform around the sides of the coil taking into account its thickness and diameter. Slots 60' and/or slits 60" may be fashioned into the material, which subsequently form the discontinuities that will define the webbing 62. In one embodiment, scores 55 may be drawn along the length of the material for bending the edges of the planar sheet into side panels 27, 28 that span the sides of the object 10. FIGS. 1*a* and 1*b* depict a perspective view of the overwrap 20 around object 10 in this position. As shown, the sheet edges or sides bend around the sides of the coil of wire to form legs or side panels.

The present disclosure also relates to a method of insulating a coil of wire 10'. The first step of the method may include providing an overwrap 20 according to FIGS. 1 and 2. Another step may include winding the overwrap 20 around the exterior or circumference of the coil of wire 10'. As the overwrap 20 is wound, the channel is formed by a bending action imposed on the folding scores, forming side panels that extend over the sides of the coil of wire 10'. Subsequently, the overwrap 20, now formed into the channel, may be pressed against the coil of wire and conformed to its side by overlapping the individual side panel sections 19 in a manner consistent with that described above. It will be recalled that the webs 62 limit bypass of the side panels to substantially cover the object 10. In this way, the overwrap 20 forms a barrier against frictional forces that might rupture the bag during transportation and/or storage of the object 10. Additional steps include securing the first side 35 of the overwrap 20 to the second side 40 of the overwrap 20 with fastening means such as tape, glue, staples, or other adhesive products. Then, the coil of wire and overwrap 20 combination is placed in a bag 15 and hermetically sealed to maintain the factory standards and preserve the atmosphere inside the bag.

The overwrap has been described with reference to various embodiments and alternates thereof. It is believed that many modifications or alterations to the embodiments disclosed will readily suggest and render obvious themselves to one skilled in the art upon reading and understanding the detailed description of the drawings. It is intended to include within the scope of this overwrap all such modifications and alterations in so far as they come within the scope of the present disclosure.

What is claimed is:

1. An overwrap for covering an associated object having a body and one or more angled faces, the overwrap comprising:

an overwrap body for covering a first portion of the associated object, said overwrap body having first and second sides, an exterior surface of said overwrap comprises a generally smooth exterior surface and an interior surface of said overwrap comprises an undulated compressible surface; and, at least one side panel that extends from a bend in the overwrap body to an interior circumferential edge of said at least one side panel and that folds upon itself to cover at least one face of the associated object, wherein the at least one side panel includes webbing that constrains the at least one side panel to fold upon itself in a substantially uniform manner within said at least one side panel, wherein the overwrap further includes one or more spaced apart material discontinuities incorporated into and contained solely within the at least one side panel thereby defining adjacent side panel segments, said one or more spaced apart material discontinuities not extending to said bend, said one or more spaced apart material discontinuities not extending to said interior circumferential edge of said at least one side panel, said one or more spaced apart material discontinuities not extending to said bend, said one or more spaced apart material discontinuities being completely positioned within a plane of said at least one side panel, and further wherein the adjacent side panel segments overlap in a substantially uniform manner at the one or more spaced apart material discontinuities.

2. The overwrap as defined in claim 1, wherein the one or more spaced apart material discontinuities comprise spaced apart slots fashioned in the at least one side panel.

3. The overwrap as defined in claim 2, wherein the slots have a tapered configuration and a width that defines the how far one panel segment overlaps an adjacent panel segment.

4. The overwrap as defined in claim 1, wherein the one or more spaced apart material discontinuities comprise spaced apart slits fashioned in the at least one side panel.

5. The overwrap as defined in claim 4, wherein the spaced apart slits are non-linear and substantially equidistantly spaced apart.

6. An overwrap for covering an associated generally cylindrical object, said overwrap having first and second overwrap side panels, said cylindrical object having first and second cylinder side faces spaced apart by a circumferential surface of said cylindrical object, the overwrap comprising:

an overwrap body for covering the circumferential surface, said overwrap body having first and second overwrap side panels;

said first and second overwrap side panels extending from a bend in the overwrap body to either of a peripheral edge of said first and second overwrap sides to form a concave channel that covers the first and second cylinder faces, wherein at least one of the side panels is fashioned from material having a plurality of spaced apart discontinuities that constrain the at least one of the side panels to fold at equidistantly spaced apart intervals; and wherein, said one or more spaced apart discontinuities extend through said overwrap panels creating an aperture, said one or more spaced apart discontinuities not extending to an interior circumferential edge of said at least one overwrap side panel, said one or more spaced apart discontinuities not extending to said ben, said one or more spaced apart material discontinuities being positioned within and contained solely within a horizontal plane of said first and second overwrap sides, and further wherein each of said discontinuities are quadrilateral polygons having a bottom and a top width, said bottom width greater than said top width, said bottom width adjacent said edge of said first and second side, and further wherein the concave channel defines an interior surface that includes a plurality of flexible undulations that conform to the associated generally cylindrical object.

7. The overwrap as defined in claim 6, wherein the channel defines an exterior surface that is substantially smooth.

8. The overwrap as defined in claim 6, wherein an interior of said overwrap body is selected from the group consisting of textured, corrugated and undulated.

9. The overwrap as defined in claim 6, wherein the first and second overwrap side panels fold proportionately to the dimensions of the plurality of spaced apart discontinuities.

10. The overwrap as defined in claim 6, wherein the plurality of spaced apart discontinuities comprise one or more holes fashioned in the first and second side panels.

11. The overwrap as defined in claim 10, wherein the one or more holes are generally elongate terminating at a web of material that circumscribes an inner edge of the channel.

12. A system for containing an associated coil of wire having a circumferential coil face and a pair of lateral coil faces generally normal to said circumferential coil face and a plurality of surface protrusions, the system comprising:

an overwrap which covers said circumferential and pair of lateral coil faces, said overwrap having a circumferential overwrap side and a pair of opposed overwrap sides generally normal to said circumferential overwrap side, said opposed pair of overwrap sides extending from a bend in said overwrap to a lateral edge of said pair of overwrap sides, an overwrap incorporating means for conforming the overwrap to fold into a substantially smooth outer surface that covers the circumferential coil face and the pair of lateral coil faces, said means selected from the group consisting of equidistantly spaced apart material discontinuities, slots, slits and variances in material thickness, said means completely positioned within said pair of overwrap sides of said overwrap, said means not extending to an inner circumferential edge of said overwrap sides, said means not extending to an outer circumferential edge of said overwrap sides, and wherein the overwrap is adapted to deform for leveling the plurality of surface protrusions thereby forming a smooth surface around the associated coil of wire; and, a hermetically sealable bag sized to receive the overwrap and the associated coil of wire.

13. The system as defined in claim 12, wherein adjacent panel sections are joined by a contiguous web of material at respective ends.

14. The system as defined in claim 12, wherein the breaks comprise tapered gaps that define an opening, and wherein the adjacent panel sections fold upon themselves to cover the opening.

15. The system as defined in claim 12, wherein the overwrap has a first side that includes a series of undulations that deform to substantially level out the plurality of surface protrusions.

16. The system as defined in claim 15, wherein the overwrap defines a second side that is free of undulations.

17. A method of packaging an object having one or more protrusions, the steps comprising:

providing a generally planar overwrap having an overwrap body and at least one side panel laterally extending from the overwrap body, wherein the at least one side panel is segmented into multiple panel sections by one or more generally tapered slots, each slot having a width at an end of said taper, each slot having a width at a start of said taper, each of said width at said end of said taper being greater than each of said width at a start of said taper, each slot equidistantly spaced apart, each slot constraining one panel section to fold onto an adjacent panel section by a predetermined amount, said slots not extending to an interior circumferential edge of said at least one side panel, said slots not extending to an outer circumferential edge of said at least one side panel, said slots being completely positioned within said at least one side panel;

forming the generally planar overwrap in a concave channel;

conforming the generally planar overwrap onto the object; and, sealing the overwrap and object in a hermetically sealable bag.

18. The method as defined in claim 17, wherein the one or more slots has a width, and wherein the predetermined amount is substantially equal to the width of the one or more slots.

* * * * *